US005873783A

United States Patent [19]

McBain et al.

[11] Patent Number: 5,873,783

[45] Date of Patent: Feb. 23, 1999

[54] BATON WEIGHTS

[75] Inventors: Scott A. McBain, Bay Village; Robert V. Vickers, Chagrin Falls, both of Ohio

[73] Assignee: Security World International Holding L.L.C., Sharon, Pa.

[21] Appl. No.: 88,037

[22] Filed: Jun. 1, 1998

[51] Int. Cl.[6] ..... A63B 67/00

[52] U.S. Cl. ..... 403/47.7; 135/75

[58] Field of Search ..... 463/47.2, 47.7; 135/75, 77, 78; 473/296; 116/110 R, 115

[56] References Cited

U.S. PATENT DOCUMENTS

| | | |
|---|---|---|
| 1,909,932 | 5/1933 | Diegel . |
| 3,371,930 | 3/1968 | Shiga . |
| 3,554,546 | 1/1971 | Braunhut . |
| 4,037,839 | 7/1977 | Nelson . |
| 4,135,719 | 1/1979 | Braunhut . |
| 4,492,377 | 1/1985 | Eby . |
| 4,533,140 | 8/1985 | Champion . |
| 4,667,958 | 5/1987 | Raitto . |
| 4,752,072 | 6/1988 | Parsons . |
| 5,110,375 | 5/1992 | Parsons . |
| 5,161,800 | 11/1992 | Parsons . |
| 5,348,297 | 9/1994 | Parsons . |
| 5,356,139 | 10/1994 | Parsons . |

FOREIGN PATENT DOCUMENTS

| | | |
|---|---|---|
| 543517 | 7/1957 | Canada . |
| 356481 | 1/1923 | Germany . |
| 16565 | 7/1903 | United Kingdom . |

*Primary Examiner*—William M. Pierce
*Attorney, Agent, or Firm*—Vickers, Daniels & Young

[57] ABSTRACT

An improved combination hand weight and expandable baton is provided. The baton is adjustable for length and weight. The baton includes a handle section which is preferably a hollow cylindrical tube and at least one telescoping section capable of being contained within the handle section. The baton is provided with a removable end cap which has a tapered inner surface that captures a flared end portion of the interior telescoping section to provide a tight taper joint when the baton is in an expanded position. By providing different end caps, any number of intermediate telescoping sections may be placed within the handle section to vary both the weight and the expandable length of the baton.

16 Claims, 2 Drawing Sheets

BATON WEIGHTS

The present invention is directed to an expandable baton which is uniquely adjustable for length and weight for use by joggers and the like as hand weights and also as a security instrument to ward off attack by dogs or other stray animals.

INCORPORATION BY REFERENCE

Reference may be had to U.S. Pat. No. 5,348,297, incorporated by reference herein for a description of expandable batons known in the prior art in order that such batons need not be described in detail herein.

BACKGROUND OF THE INVENTION

Hand weights are commonly used as physical fitness instruments by joggers, walkers, or other physical fitness enthusiasts. These hand weights help develop muscle tone, as well as physical endurance during the natural arm and hand movement of a workout. Light hand weights are preferred over heavier hand weights, since the objective is to build stamina, physical endurance and muscle tone without detracting from the overall workout associated with the primary exercise, i.e., walking or jogging. In other than closed environments, such as health club tracks or shopping malls, walkers and joggers are subject to physical attack from dogs and other animals. Indeed, as any jogger knows, loose dogs commonly chase or attack a running person. Thus, many joggers have taken to carrying dispensing cans of pepper spray or other chemical irritants to ward off attack. Many of these same joggers also like to carry hand weights. It becomes difficult and time-intensive to juggle hand weights while accessing the can of pepper spray or other like device to defend himself or herself. The disadvantage is that a jogger is sometimes forced to forego carrying hand weights in favor of a self-defense tool or forego jogging altogether.

Walkers are faced with the same or similar decisions. A walker must often decide, before beginning his or her exercise, whether a decision should be made to forego carrying hand weights in favor of a self-defense tool, or risk not being able to act in time when attacked by a dog or other stray animal. Many walkers have taken up the age-old idea of carrying a walking stick. Such walking sticks provide a defense tool against stray animals. However, walking sticks, like pepper spray or other defense tools, prevent dual use with hand weights.

Night sticks and batons are also well known in the art as intermediate force weapons for use by law enforcement personnel. The wooden night stick has advanced to expandable telescoping batons as seen in U.S. Pat. No. 5,348,297. These telescoping batons are usually hollow, made or steel or a steel alloy, and when collapsed, the telescoping sections are nested within the handle. One of the disadvantages over prior art wooden night sticks is the additional weight a telescoping baton adds to standard issue equipment of a law enforcement officer. When a steel baton is added to the belt of an officer while already carries two-way radios, firearms, ammunition, flashlights, etc., it adds substantially to the weight of the uniform. An effort to overcome such weight as shown in U.S. Pat. No. 5,356,139, which discloses using materials of different specific weight to construct the baton. Lightweight materials, such as aluminum, are substituted where possible in order to reduce the overall weight of the baton. Obviously, substituting lighter weight products such as aluminum will weaken a baton. If a strong lightweight alloy is used, the overall cost of the baton increases significantly. Additionally, manufacturing and assembly costs are increased, since two different manufacturing processes are required to construct different sections of the baton and the manufacturing processes must then coincide in order to facilitate assembly of the different pieces.

Prior art telescoping batons also come in a variety of lengths. Thus, different size law enforcement officers can choose a length which suits their size and strength. For example, a smaller officer may feel more comfortable with a baton which expands into a longer length. The force generated at the tip of the baton is greater than a shorter length baton, since the same swinging action, over a longer length, produces a greater force. As is well known then, the longer the baton, the greater the force, all other things being constant. Conversely, a larger officer may feel more comfortable with a shorter length baton which, because of the officer's size, can impart the same amount of force as a larger baton utilized by a smaller officer. Additionally, depending on the circumstances, an officer may encounter a situation in which a longer or shorter baton would be more desirable than that with which he or she has been provided as a standard issue.

SUMMARY OF THE INVENTION

The present invention advantageously provides an improved hand weight which functions as a self-defense tool by incorporating the benefits of a telescoping baton. The invention overcomes the disadvantages of the prior telescoping batons in that it is uniquely adjustable in length and weight, in order that it can be used as a hand weight.

In this respect, an expandable baton is provided comprising a handle section, which includes a hollow cylindrical tube having a first end portion, a second end portion and a substantially uniform wall thickness which has an outer diameter and an inner diameter. The first end portion of the handle section includes a closed end wall, while the second end portion has an open end wall. At least one telescoping section is placed within the handle portion and includes a tubular portion and a flared end portion.

The telescoping section has first and second opposite open ends with the first open end on the flared end portion and having an outer diameter which is smaller than the outer diameter of the second open end. The flared end portion includes inner and outer diameters which continuously increase to the first open end such that the wall thickness of the flared end portion is substantially uniform throughout the portion. A removable end cap is fitted on the open end wall of the handle section. The removable end cap includes a central bore having a truncated cone inner surface terminating at an open cone end and a tip receiving inner surface terminating at an open tip end opposite the open cone end. The truncated cone surface has a continuously increasing inner diameter to the open cone end and toward the interior of the handle section. The forward telescoping section is slidably carried in the handle section and is moveable between a retracted position within the handle section to an extended position outward through the removable end cap. The flared end portion of the forward telescoping section is wedged tightly into the truncated cone portion of the removable end cap in the extended position to effectively lock the forward telescoping section outward of the handle section and in an extended position.

The removable end cap allows that an intermediate telescoping section may be added to the baton, disposed between the handle section and the forward telescoping section. The intermediate telescoping section includes a flared end portion similar in shape to the flared end portion of the forward telescoping section and a truncated cone portion opposite the flared end portion which is similar in shape to the truncated cone surface of the removable end cap. The intermediate telescoping section then includes a tubular portion between the flared end portion and the truncated cone portion. The flared end portion of the intermediate telescoping section has an outer diameter at a flared open end which is smaller than the inner diameter of the handle section and is larger than the outer diameter of the forward telescoping section. The truncated cone portion has inner and outer diameters continuously decreasing toward a truncated open end such that a wall thickness of the truncated cone portion is substantially uniform throughout the truncated cone portion. The forward telescoping section includes a removable tip, preferably the tip including a threaded shaft which is screwed into a threaded bore of the forward telescoping section.

The above described geometry of the telescoping baton allows that the baton may be easily adjusted for length and weight for the specific need of the user, such as an adjustable hand weight for joggers. The adjustability in length and weight is accomplished without resort to special alloys, lightweight materials or a combination of heavy and lightweight materials. The weight and length of the baton are adjusted since the baton has the easy ability to remove the intermediate telescoping section within the main section. This is accomplished by providing two different size removable caps. One cap is fitted with a truncated cone inner surface adapted to engage the flared end portion of the forward telescoping section. A replacement cap is formed with a truncated cone inner surface which is sized to engage the flared end portion of the intermediate telescoping section. Therefore, either telescoping section can wedge or engage with a removable end cap. Further, the removable end cap is placed at the extension end of the baton to facilitate easily adding or removing an intermediate telescoping section. To effect the change, a person need only remove the tip from the forward telescoping section, slide the intermediate telescoping section off (or on, as the case may be), replace the tip on the forward telescoping section, place the telescoping sections within the main handle section and fit the appropriate cap onto the extension end of the handle section.

It is thus an outstanding object of the present invention to provide an improved hand weight which comprises an expandable baton that is easily adjustable in both length and weight.

It is yet another object of the present invention to provide an expandable baton which can be used as both a physical fitness devise and a self-defense tool. Still another object of the present invention is to provide an expandable baton which is easily adjustable in length according to the specific requirements of the user.

Yet another object of the present invention is to provide an expandable baton which has a dual use as a hand weight and is adjustable in weight.

Yet still another object of the present invention is to provide an expandable baton which has all the advantages described above while maintaining a self-locking feature.

These and other objects of the invention will become apparent to those skilled in the art upon reading and understanding the following detailed description of the embodiments.

BRIEF DESCRIPTION OF THE DRAWINGS

The invention may take physical form in certain parts and arrangement of parts, the preferred embodiment of which will be described in detail and illustrated in the accompanying drawings which form a part hereof and wherein.

DESCRIPTION OF THE PREFERRED EMBODIMENT

Figure 1:
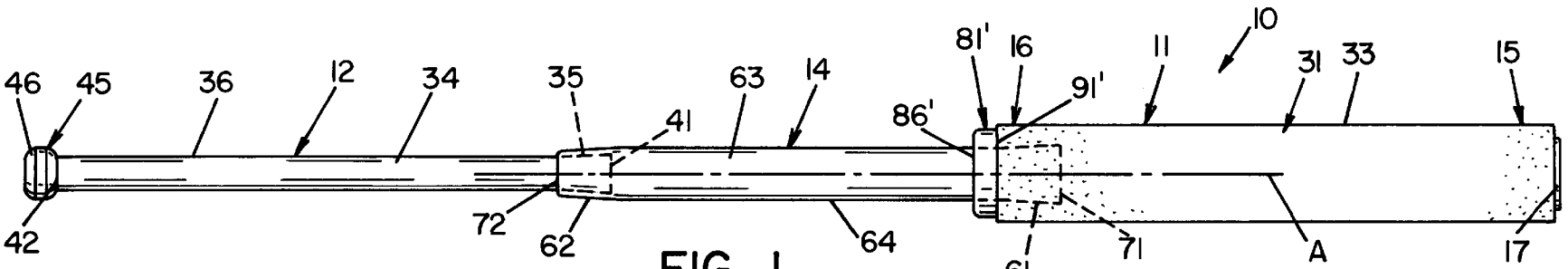
FIG. 1 is a plan view of the expandable baton of the present invention.
Figure 2:
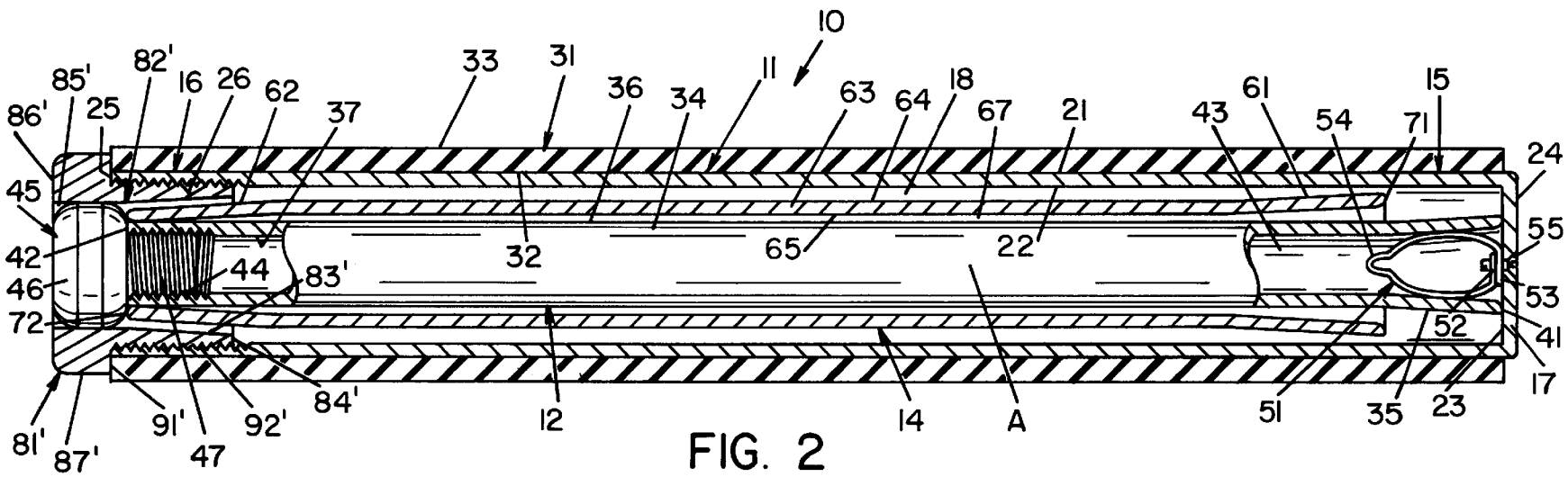
FIG. 2 is a plan view, partially in cross section, showing the expandable baton of FIG. 1.

Referring now to the drawings wherein the showings are for the purpose of illustrating the preferred embodiment of the invention only, and not for the purpose of limiting same, FIGS. 1 and 2 show an expandable baton 10 comprising a handle section 11, a forward telescoping section 12, and an intermediate telescoping section 14. Sections 11, 12 and 14 are expandable and collapsible along an axis A. Handle section 11 includes a hollow cylindrical tube which has a first end portion 15 and a second end portion 16, first end portion 15 having a closed end wall 17. It will be appreciated that handle section 11 has an outer cylindrical surface 21 defining an outer diameter of handle section 11 and an inner cylindrical surface 22 defining an inner diameter of handle section 11. Closed end wall 17 includes inner surface 23 facing the interior of handle section 11 and exterior surface 24 facing outward of the interior.

Second end portion 16 includes an open end wall 25 which essentially forms a ring spanning between the inner cylindrical surface 22 and the outer cylindrical surface 21 of handle section 11. Extending from open end wall 25 into the interior space 18 of handle section 11 and specifically, along inner cylindrical surface 22 is a female threaded portion 26 for purposes which will be described hereinbelow.

A flexible sleeve 31 preferably made of foam rubber, flexible plastic or the like, is fitted over outer cylindrical surface 21 of handle section 11. Flexible sleeve 31 has a length substantially the same as handle section 11, an inner cylindrical surface 32 in engagement with outer cylindrical surface 21 and having a diameter substantially equal thereto. Flexible sleeve 31 also includes an outer wear surface 33 which provides an easy-to-grip surface which will not easily slip from a user's hand. Though not shown, outer wear surface 33 may include finger depressions or other molded shapes for easy handling and gripping of handle section 11.

Forward telescoping section 12 is also hollow and tubular and includes an elongated tubular portion 34 and a flared end portion 35. Forward telescoping section 12 includes an outer surface 36 and an inner surface 37 which defines a thickness therebetween. A flared open end 41 spans between outer surface 36 and inner surface 37 at flared end portion 35. The thickness shown at flared open end 41 is substantially uniform to the thickness throughout telescoping section 12 defined by the distance between outer surface 36 and inner surface 37. Opposite flared open end 41 is a tubular open end 42. Tubular open end 42 has a thickness substantially the same as flared open end 41. It will be appreciated that the axial length of forward telescoping section 12 is only slightly less than the axial length of handle section 11 such that telescoping section 12 neatly fits within the interior space 18 of handle section 11.

Extending from tubular open end 42 into an interior 43 is a threaded bore portion 44 on the inner surface 37 of forward telescoping section 12. A weighted removable tip 45 is provided at the tubular open end 42 of forward telescoping section 12. Removable tip 45 includes a weighted tip portion 46 which is elliptical in cross section and has a threaded shaft 47 extending therefrom. As can be seen from FIG. 2, threaded shaft 47 is screwed into threaded bore portion 44 to effectively close tubular open end 42. Unlike handle section 11 and forward telescoping section 12 described hereinabove, removable tip portion 46 is a solid component in order that expandable baton 10 have a significant weight at the end for greater striking force.

Figure 4:
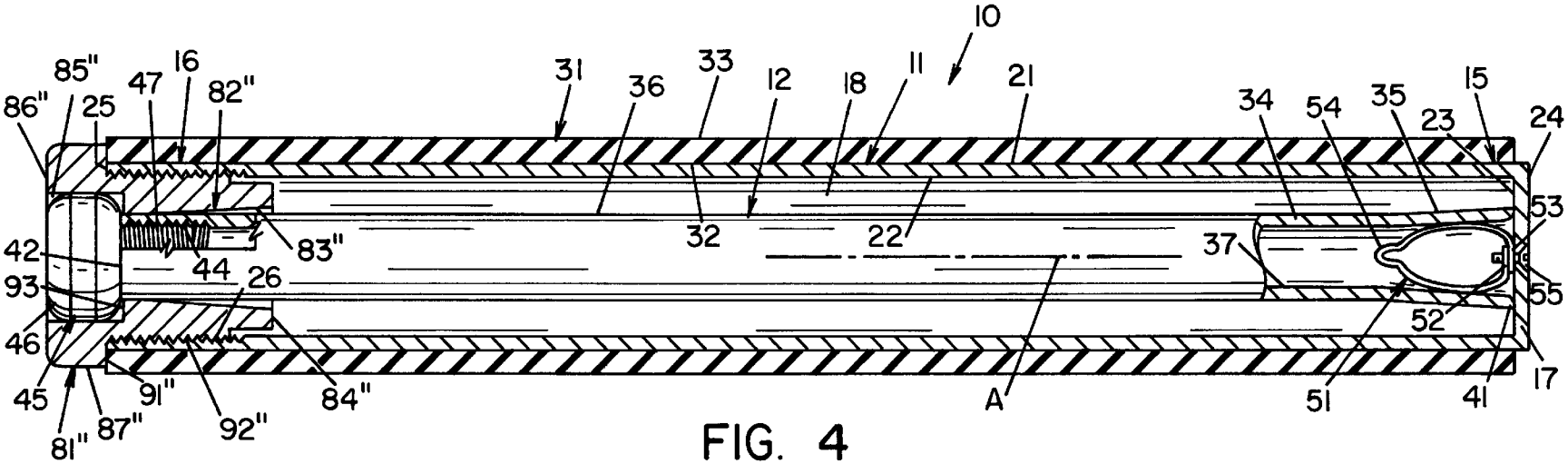

Attached to closed end wall 17 is a spring clip 51 axially extending into interior space 18 and, when expandable baton 10 is in its retracted position as shown in FIGS. 2 and 4, within interior 43 of forward telescoping section 12. As shown in cross section in FIGS. 2 and 4, spring clip 51 is elliptical in shape having a nose extending axially within baton 10. Preferably, spring clip 51 is comprised of a single piece of spring steel having opposite overlapping ends 52 and 53 and a closed inwardly extending nose end 54 on the nose portion of spring clip 51. A small hole is tapped in the axial center of closed end wall 17 through which a screw 55 is placed and which screw retains overlapping ends 52 and 53 in place. Spring clip 51, as shown in FIGS. 2 and 4, has an outer dimension at its widest point sized for frictional engagement with the inner diameter of flared end portion 35. Closed nose end 54 allows spring clip 51 to elastically expand and contract in order to "catch" flared end portion 35.

As can be seen in FIGS. 1 and 2, expandable baton 10 can be fitted with the intermediate telescoping section 14. Intermediate telescoping section 14 is disposed between handle section 11, in the interior space 18 and, as can be seen in FIG. 2, fits over forward telescoping section 12. Intermediate telescoping section 14 includes a flared end portion 61, a truncated cone portion 62 and a tubular portion 63 therebetween. Telescoping section 14 includes an outer surface 64 and an inner surface 65 defining a hollow inner space 67. Both outer surface 64 and inner surface 65 have inner and outer diameters, respectively, the outer diameter of telescoping section 14 being the largest at flared open end surface 71 which spans between outer surface 64 and inner surface 65. Conversely, the smallest outer diameter of intermediate telescoping section 14 is found at truncated cone portion 62 and specifically at truncated open end surface 72. It will be appreciated that the wall thickness of intermediate telescoping section 14 showed at flared open end surface 71 and truncated open end surface 72 is generally constant throughout the entirety of intermediate telescoping section 14 and is substantially uniform in flared end portion 61, truncated cone portion 62 and tubular portion 63. As shown in FIG. 2, truncated cone portion 62 has inner and outer diameters continuously decreasing from tubular portion 63 toward truncated open end surface 72, while flared end portion 61 has inner and outer diameters continuously increasing from tubular portion 63 to flared open end surface 71. The inner and outer diameters of tubular portion 63 are generally constant throughout and coincide with the largest inner and outer diameters for truncated cone portion 62 and the smallest inner and outer diameters for flared end portion 61.

Figure 3:
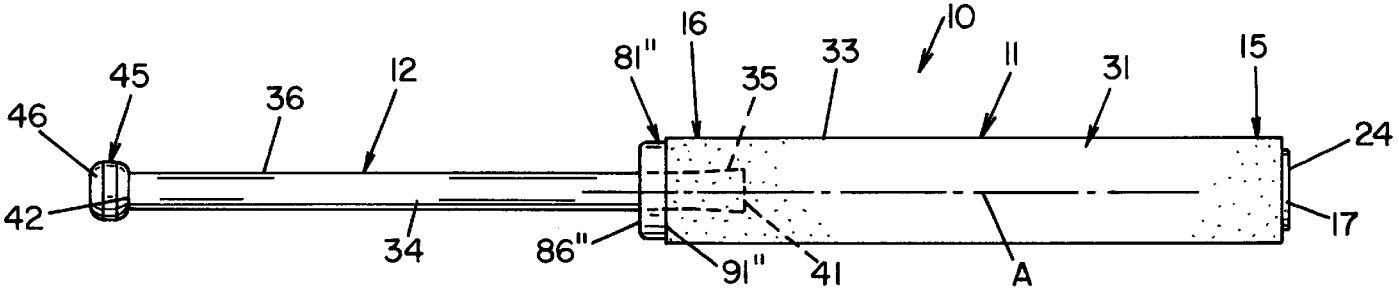
FIG. 3 is a plan view of the expandable baton of FIG. 1, which has been adjusted in both size and weight; and, FIG. 4 is a plan view, partially in cross section, of the expandable baton of FIG. 3.

It will be appreciated that the description to this point has related to expandable baton 10 shown in FIGS. 1–4, the difference being that FIGS. 1 and 2 show expandable baton 10 including handle section 11, forward telescoping section 12 and intermediate telescoping section 14, while FIGS. 3 and 4 show baton 10 with intermediate telescoping section 14 having been removed. Importantly in this respect, handle section 11 is capable of being fitted with at least two different removable end caps 81' as shown in FIGS. 1 and 2, and 81" as shown in FIGS. 3 and 4. Common features of the removable end caps 81' and 81" will be described hereinafter using common reference numerals but denoting the prime symbol (') for FIGS. 1 and 2 and the double prime symbol (") for FIGS. 3 and 4.

As can be seen, removable end cap 81' and 81" include a central bore 82', 82" which includes a truncated cone inner surface portion 83', 83" which terminates at an open cone end 84', 84". Also part of central bore 82', 82" is a tip receiving bore portion 85', 85" which extends from truncated cone inner surface portion 83', 83" to an open tip end surface 86', 86". The outer diameter of end cap 81', 81" is defined by an outer circumferential surface 87', 87" which terminates in an outer shoulder portion 91', 91 " which is flush and abuts against open end wall 25. Extending downwardly from shoulder portion 91', 91" is a threaded shank 92', 92". It will be appreciated that threaded shank 92', 92" are of generally equal diameters in order that either cap 81 ' or 81" can be threaded into female threaded portion 26 of handle section 11. It will thus be appreciated that the thickness between inner surface portion 83', 83" and threaded shank 92', 92" becomes increasingly larger as cap 81', 81" is viewed from right to left, i.e., from open cone end 84', 84" toward tip receiving bore portion 85', 85". As can be seen in FIG. 4, end cap 81" includes a ledge 93 within tip receiving bore portion 85' since truncated cone inner surface portion 83' is sized for mutual engagement with flared end portion 35 of forward telescoping section 12 in converse to truncated cone inner surface portion 83', sized for mutual engagement with flared end portion 61 of intermediate telescoping section 14, as shown in FIG. 1.

It will be appreciated that, as shown in the prior art, the flared end portions 35 and 61 are sized for mutual engagement with truncated cone portion 62 and truncated cone inner surface portion 83', as shown in FIGS. 1 and 2, or alternatively, as shown in FIGS. 3 and 4, flared end portion 35 will mutually engage with truncated cone inner surface portion 83". The mutual engagement forms a tight taper joint when expandable baton 10 is in its extended position as shown in FIGS. 1 and 3. A tight taper joint is formed since complimentary interior and exterior surfaces are of slightly different angles. This type of joint provides great rigidity to baton 10 in its extended position. Thus, baton 10 can be used as both a prod, i.e. by poking weighted tip portion 46 in the direction of an animal, or as a club by swinging expandable baton 10.

In its collapsed position as shown in FIGS. 2 and 4, telescoping sections 12 and 14 of baton 10 are wholly contained within handle section 11 and suitably retained therein by spring clip 51 to allow a user to easily grasp the outer flexible sleeve 31. Thus, baton 10 can be used as hand weights by joggers or other fitness enthusiasts. The overall weight of the baton can easily be changed between that shown in FIGS. 1 and 2 to that shown in FIGS. 3 and 4 or vice versa. For example, to remove intermediate telescoping section 14, a person need only unscrew removable tip 45 and removable end cap 81' as shown in FIG. 2. Intermediate telescoping section 14 is then easily slid out of interior space 18 and can be set aside. As shown in FIG. 4, removable end cap 81' is replaced with removable end cap 81" and removable tip 45 is again screwed into forward telescoping section 12. Thus, both the length and overall weight of the baton 10 has been changed significantly, the length reduced by a third and the weight reduced by 10–25%.

It will be appreciated that additional intermediate telescoping sections can be added to the preferred embodiment shown in order that a range of weights and lengths is available, limited only by the number of differently sized removable end caps one would want to keep on hand. Each of the removable end caps would be sized so that the truncated cone inner surface portion would tightly fit with the flared end portion of the intermediate telescoping section.

The invention has been described with specific reference to the preferred embodiments and modifications thereto. Further modifications and alterations may occur to others upon reading and understanding the specification. It is intended to include all such modifications and alterations insofar as they come within the scope of the invention.

Having thus described the invention, it is claimed:

1. An expandable baton which is adjustable for length and weight comprising, a handle section including an axially extending hollow cylindrical tube having a first end portion, a second end portion and a substantially uniform wall thickness defining an outer diameter and an inner diameter of said handle section, said first end portion having a closed end wall and said second end portion having an open end wall and including means for receiving an end cap;

an axially extending forward telescoping section including a tubular portion and a flared end portion, said telescoping section having first and second opposite open ends said first open end on said flared end portion having an outer diameter which is smaller than the inner diameter of said handle section, said second open end on said tubular portion having an outer diameter which is smaller than said outer diameter of said flared end portion, said flared end portion having a predetermined length, a wall thickness, an inner diameter and an outer diameter, each of said inner and outer diameters of said flared end portion continuously increasing to said first open end such that said wall thickness is substantially uniform throughout said flared end portion;

a removable end cap fitted into said end cap receiving means, said removable end cap including an axially extending central bore having a truncated cone inner surface terminating at an open cone end and a tip receiving inner surface terminating at an open tip end opposite said open cone end, said truncated cone surface having a continuously increasing inner diameter to said open cone end, said forward telescoping section slidably carried in said handle section and axially movable between a retracted position within said handle section to an extended position outward through said removable end cap, said flared end portion wedged tightly into said truncated cone portion in said extended position.

2. The baton of claim 1, wherein said means for receiving an end cap includes a female threaded portion extending inwardly into said handle section on said second end portion.

3. The baton of claim 2, wherein said removable cap includes an exterior threaded surface generally opposite said truncated cone inner surface, said threaded surface matingly engaging said female threaded portion.

4. The baton of claim 3, wherein said open tip end has an outer shoulder portion extending therefrom, said outer shoulder portion engaging said open end wall.

5. The baton of claim 1, including a flexible sleeve fitted over said handle section and generally extending between said closed end wall and said open end wall.

6. The baton of claim 1, including a removable tip and said telescoping section includes means for receiving said tip.

7. The baton of claim 6, wherein said removable tip includes a threaded shaft and said means for receiving said tip includes a threaded bore extending into said forward telescoping section from said second open end, said threaded shaft engaged within said threaded bore.

8. The baton of claim 1, including retaining means extending from said closed end wall for holding said forward telescoping section in the retracted position.

9. The baton of claim 8, wherein said retaining means is a spring clip having a closed tip extending into said handle section for engaging said flared end portion of said forward telescoping section.

10. The baton of claim 9, wherein said spring clip includes a base portion attached to said closed end wall by a screw extending through said closed end wall and into said base portion.

11. The baton of claim 1, including an intermediate telescoping section disposed between said handle section and said forward telescoping section.

12. The baton of claim 11, wherein said intermediate telescoping section includes a flared end portion, a truncated cone portion and a tubular portion therebetween.

13. The baton of claim 12, wherein said flared end portion has an outer diameter at a flared open end which is smaller than the inner diameter of said handle section and is larger than said outer diameter of said forward telescoping section.

14. The baton of claim 13, wherein said flared end portion has inner and outer diameters continuously increasing toward said flared open end such that a wall thickness of said flared end portion is substantially uniform throughout said flared end portion.

15. The baton of claim 12, wherein said truncated cone portion has inner and outer diameters continuously decreasing toward a truncated open end such that a wall thickness of said truncated cone portion is substantially uniform throughout said truncated cone portion.

16. An expandable baton which is adjustable for length and weight comprising, a handle section including an axially extending hollow cylindrical tube having a first end portion, a second end portion and a substantially uniform wall thickness defining an outer diameter and an inner diameter of said handle section, said first end portion having a closed end wall and said second end portion having an open end wall and including means for receiving an end cap;

an axially extending forward telescoping section including a tubular portion and a first flared end portion, said telescoping section having first and second opposite open ends said first open end on said first flared end portion having an outer diameter which is smaller than the inner diameter of said handle section, said second open end on said tubular portion having an outer diameter which is smaller than said outer diameter of said first flared end portion, said first flared end portion having a predetermined length, a wall thickness, an inner diameter and an outer diameter, each of said inner and outer diameters of said first flared end portion continuously increasing to said first open end such that said wall thickness is substantially uniform throughout said flared end portion;

an intermediate telescoping section disposed between said handle section and said forward telescoping section including a second flared end portion, a truncated cone portion and a tubular portion therebetween;

a removable end cap fitted into said end cap receiving means, said removable end cap including an axially extending central bore having a truncated cone inner surface terminating at an open cone end and a tip receiving inner surface terminating at an open tip end opposite said open cone end, said truncated cone surface having a continuously increasing inner diameter to said open cone end, said forward and intermediate telescoping sections slidably carried in said handle section and axially movable between a retracted position within said handle section to an extended position outward through said removable end cap, said second flared end portion wedged tightly into said truncated cone portion of said removable end cap in said extended position.

* * * * *